US005839541A

United States Patent [19]

Jeron et al.

[11] Patent Number: 5,839,541

[45] Date of Patent: Nov. 24, 1998

[54] DEVICE FOR LOWERING A LOAD ALONG A METAL BAND

[75] Inventors: Alain Francois Jeron, Copenhagen; Torben Lindhoft Jensen, Ishoj, both of Denmark

[73] Assignee: ERJ Management APS, Greve Strand, Denmark

[21] Appl. No.: 397,228

[22] PCT Filed: Jul. 12, 1994

[86] PCT No.: PCT/DK94/00284

§ 371 Date: Jun. 2, 1995

§ 102(e) Date: Jun. 2, 1995

[87] PCT Pub. No.: WO95/02432

PCT Pub. Date: Jan. 26, 1995

[30] Foreign Application Priority Data

Jul. 12, 1993 [DK] Denmark ..... 0836/93

[51] Int. Cl.[6] ..... A62B 1/20

[52] U.S. Cl. ..... 182/192; 182/71; 188/65.1

[58] Field of Search ..... 182/192, 71, 11, 182/231, 235; 188/65.1, 174

[56] References Cited

U.S. PATENT DOCUMENTS

| | | | |
|---|---|---|---|
| 3,756,565 | 9/1973 | Sakai | 188/65.1 X |
| 3,926,278 | 12/1975 | Molnar et al. | 182/7 |
| 4,462,554 | 7/1984 | Gyoda | 188/65.1 X |
| 4,588,046 | 5/1986 | van der Neer | 182/192 X |
| 4,662,475 | 5/1987 | Rütschi et al. | 182/192 X |

FOREIGN PATENT DOCUMENTS

| | | | |
|---|---|---|---|
| 157172 | 11/1989 | Denmark | A62B 1/14 |
| 0157150 | 10/1985 | European Pat. Off. | A62B 1/14 |
| 2617050 | 12/1988 | France . | |
| 2417797 | 10/1975 | Germany . | |
| 3922825 | 1/1991 | Germany . | |
| 2165449 | 4/1986 | United Kingdom . | |

*Primary Examiner*—Ramon O. Ramirez
*Assistant Examiner*—Brian J. Hamilla
*Attorney, Agent, or Firm*—Merchant, Gould, Smith, Edell, Welter & Schmidt, P.A.

[57] ABSTRACT

A device for lowering a load along a metal band (2) comprises a brake housing (4) accommodating a brake mechanism with at least one brake shoe (14, 16, 34, 36, 54, 56 74, 76) which acts on the metal band (2). The brake shoe (14, 16, 34, 36, 54, 56, 74, 76) is pressed against the metal band (2) by a force which depends on the mass or load. The load is suspended from a load wedge (17, 37, 57, 77) which, in the brake mechanism converts a pull substantially in the longitudinal direction of the metal band (2) to a pressure acting on the metal band (2) through said brake shoe (14, 16, 34, 36, 54, 56, 74, 76).

10 Claims, 4 Drawing Sheets

DEVICE FOR LOWERING A LOAD ALONG A METAL BAND

FIELD OF THE INVENTION

The invention concerns a lowering device for lowering a load along a metal band. The device comprises a brake housing which accommodates a brake mechanism having a brake shoe which acts on the metal band. This brake shoe is pressed against the metal band by a force which depends on the mass of the load.

Lowering devices of this type will particularly be used in connection with rescue equipment, where e.g. persons are to be evacuated from tall buildings and the like, e.g. in case of fire.

DESCRIPTION OF THE RELATED ART

British patent application GB-A-2165449 and French patent application 2617050 disclose a lowering mechanism which is adapted to be attached to a rail fixed to a wall of a building. A person can hereby be evacuated along the rail by being lowered along it at a speed controlled by the brake mechanism. Rails of this type will be subject to the weather and therefore require maintenance. A person desiring such optimum safety will, when on a business trip or the like, be forced to choose his hotel in dependence on whether such a safety system has been installed. The system of these patent specifications Is thus not suitable for affording individual safety to a person.

German Offenlegungsschrift DE 2417797 discloses a lowering mechanism, where a person can be lowered by means of a cable. This cable is wound around a drum which is braked by a brake mechanism associated with the drum. The brake mechanism has a variable braking which must be set in response to the person's weight. However, it is extremely inexpedient that the braking is variable and depends on the person's weight. Persons using this type of equipment in emergencies will often be on the brink of panicking and therefore have difficulty in setting the braking correctly.

German Offenlegungsschrift DE 3922825 discloses a lowering device in which the cable has been replaced by a belt. The belt is wound on a drum, which is braked in that granular material serving to brake the rotor of the drum is interposed between said rotor of the drum and the stator of the lowering device. The braking is not load-dependent in this case either, and it is not even possible to compensate for variations in the load.

Danish published application 157172 discloses another lowering device, where a load is lowered along a belt, which is squeezed by two brake shoes. The brake shoes are mounted pivotally about an anchoring point by means of which a moment of force is transferred to the brake shoes in response to the weight of the load. The system is not useful per se, because the mounting of the brake shoes, making them movable through an arm about the anchoring point, causes the braking to be self-increasing, which in turn means that the lowering device will look unless measures are taken to counteract this.

SUMMARY OF THE INVENTION

The object of the invention is to provide a lowering device by means of which a load may be lowered along a flat metal band, the lowering speed of the load being essentially independent of the mess or weight of the load. Further, the lowering device is to be constructed in a mechanically simple and stable manner.

This object is achieved according to the invention by the features defined in the characterizing portion of claim 1, the load being here suspended from a wedge. The wedge converts the mass of the load to a pressure acting on the metal band through at least one brake shoe. Since the load is suspended from the lowering device, the latter will be affected by a force in proportion to the mass of the load. simultaneously, a braking force applied from the brake shoe of the lowering device acts on the metal band. Of course, this force depends on the coefficient of friction between the metal band and the brake shoes, as well as by the pressure at which the brake shoes are pressed against the metal band. Since the load is suspended from a wedge, said pressure will be equal to the pull in the-wedge multiplied by a factor which depends on the angle of the wedge. The resulting force acting on the lowering device can thus be expressed by the force of gravity from the load minus the frictional force acting on the metal band. It will thus be seen that the lowering speed of the load is essentially independent of the mass of the load.

A preferred embodiment of the invention is defined in claim 2, which states that the metal band slides between two brake shoes, one of which is stationary, while the other is arranged so as to be stressed by the load wedge.

The metal band in the spool chamber, which is described in claim 3, runs essentially freely, the brake mechanism braking the metal band after the band has left the spool chamber. Since the most important forces from the braking are converted in the brake housing, the spool chamber may advantageously be constructed as stated in claim 4.

Claim 5 states how the load wedge may be incorporated in a wedge assembly, whereby a pull in the longitudinal direction of the load wedge is converted to a pressure in the transverse direction of the wedge assembly. The brake housing can hereby be made with a rectangular interior cross-section, which means that the brake housing can be manufactured by extrusion.

The wedge elements of the wedge assembly may advantageously be constructed with friction-reducing means between the individual wedges, which is stated in claim 5. These friction-reducing means may e.g. be a band of rolls which extend along the engagement faces of the wedge elements. This is stated in claim 6, and it has moreover been found that the friction reducing means may advantageously be in the form of an expansion joint of rubber, which is stated in claim 7. Such an expansion joint serves as a shock absorber, thereby ensuring that small irregularities in the metal band will not cause vibrations in the lowering device, which may be uncomfortable to the person who is being lowered. When the elements of the wedge assembly are constructed as stated in claim 8, the structure of the lowering device of the invention will be very simple and functional.

Claim 9 states that additional, externally stressable wedges may be provided in the wedge assembly, making it possible to vary the rate of descent in a simple manner by varying the load distribution between the externally stressable wedges.

Claim 10 states that usually it must be considered expedient to mount the brake shoes directly on the load wedge, while its other wall cooperates with a further wedge element.

The invention will be described more fully below in connection with preferred embodiments and with reference to the drawing, in which

DETAILED DESCRIPTION OF THE PREFERRED EMBODIMENT

Figure 1:
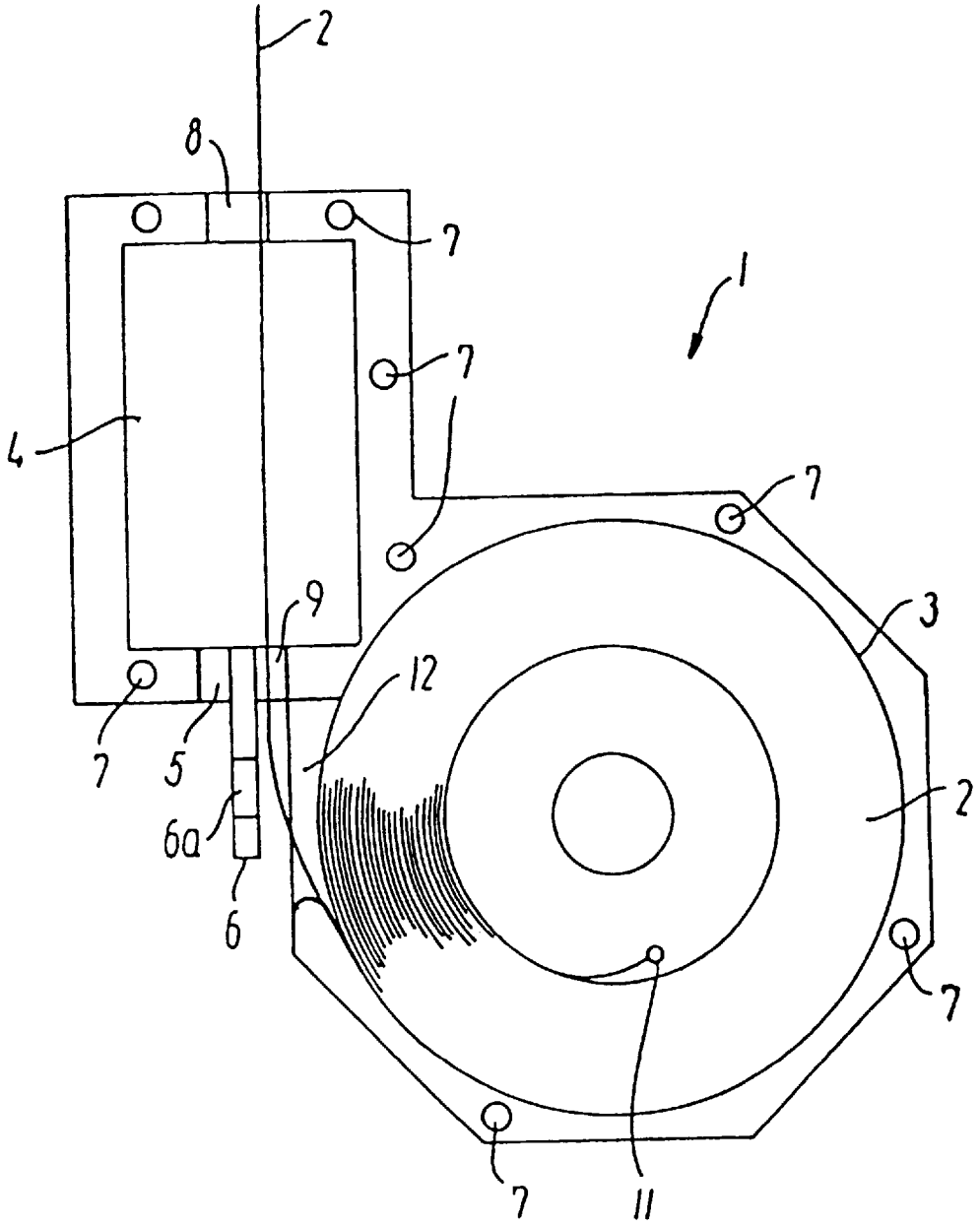
FIG. 1 shows a preferred embodiment of a lowering device according to the invention, whose one side wall has been removed.
Figure 5A:
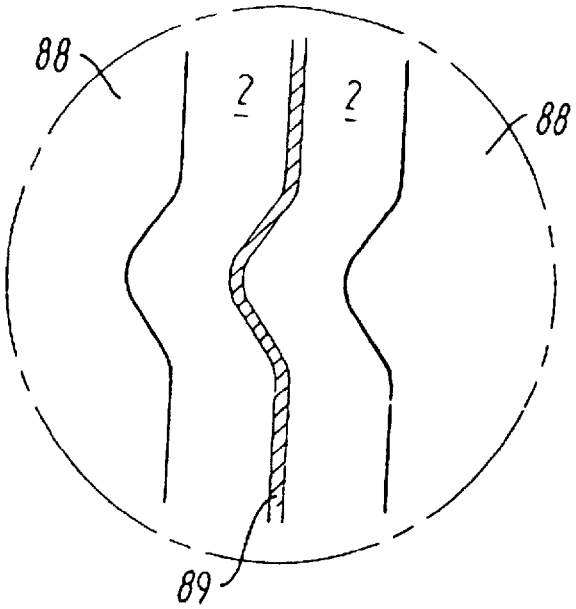
FIG. 5 is a partially sectional view of an alternative embodiment of a lowering device according to the invention, in which the load wedge is biassed with respect to another wedge incorporated in the wedge assembly.
Figure 5:
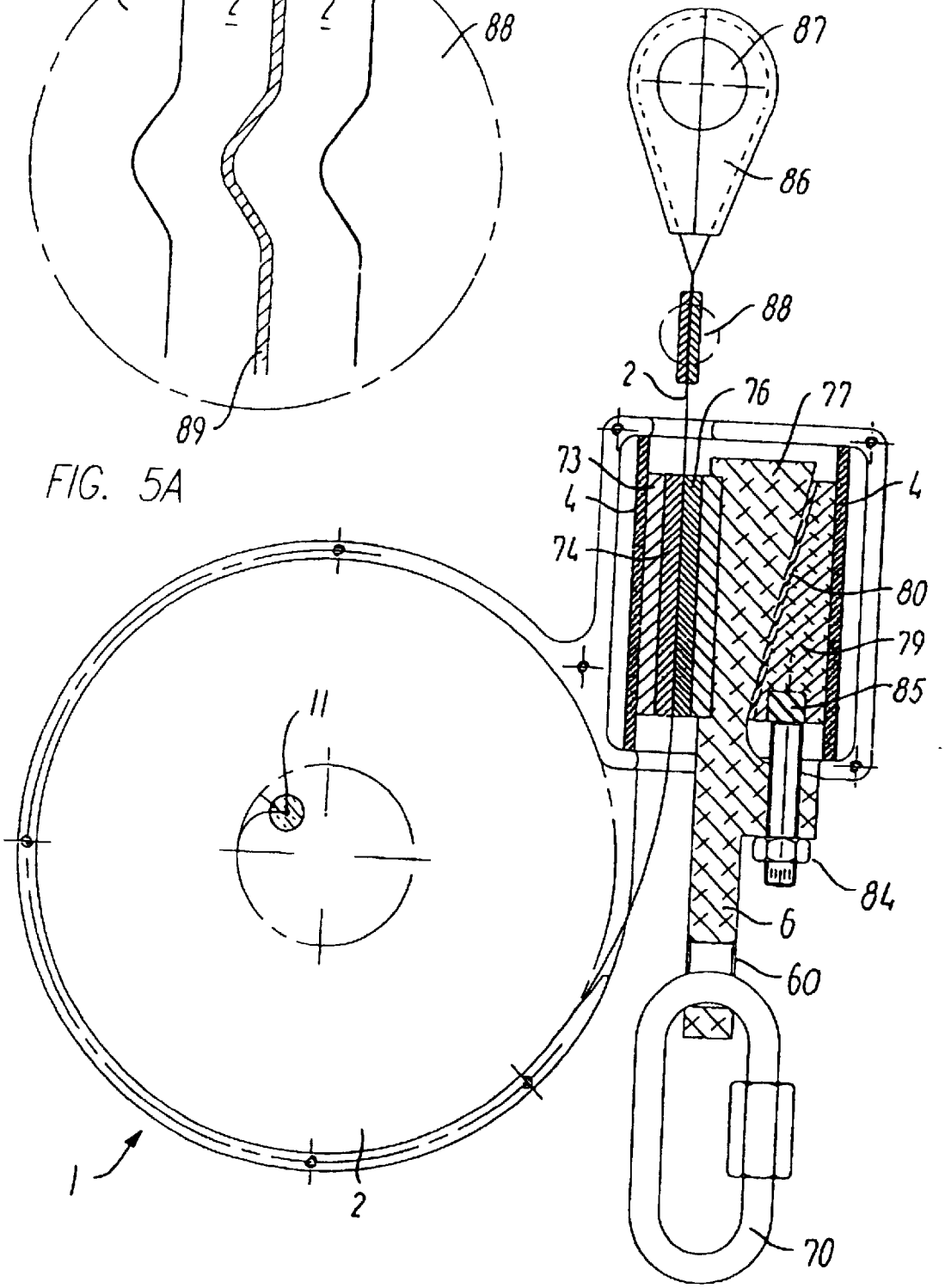

FIG. 1 shows a lowering device-according to the invention, one side of the housing 1 of the device having been removed to illustrate what the housing contains. It will be seen that the housing 1 has a spool chamber 3 in which a supply of metal band 2 has been wound. The metal band 2 runs through a brake housing 4, and the free end of the band 2 has an attachment device (not shown), which, as will be explained in connection with FIG. 5, is used for attaching the lowering device from the premises from which the lowering takes place. It will be seen that in addition to the spool chamber, the housing 1 has a brake chamber 5 in which the brake housing 4 is retained. It will be appreciated that the housing 1 is manufactured by extrusion, the extruded object being cut to lengths which correspond to the width of the lowering device.

The sides (not shown) of the device are subsequently mounted, said sides having a profile which corresponds to the contour of the lowering device shown in FIG. 1. The sides are attached to the extruded parts by means of screws which are mounted in threaded holes 7 on the housing 1. The brake housing 4 is shown with a protruding part of a load wedge 6, which is formed with an eye 6a in which a load to be lowered (not shown) may be attached. The brake chamber 5 has an outlet opening 8 through which the tightened metal band 2 leaves the brake chamber. The brake chamber 5 moreover has an access opening 9 providing access to the protruding part of the wedge 6, and through which the loose metal band 2 is fed from the spool chamber 3 through its access opening 12. In a preferred embodiment, the spool chamber 3 has a central opening 10 in the housing wall through which the wound metal band 2 may be inspected to some degree.

As will appear from the following, a pull on the load wedge causes a stress on the metal band 2, which takes place inside the brake housing 4. Thus, the stresses are applied only there, so it is essentially just small stresses that are applied elsewhere in the extruded housing 1. Accordingly, it is not necessary to dimension the actual housing 1 to resist large stresses, since the primary function of this housing is merely to ensure controlled unwinding of the metal band 2 during the lowering of the load. As mentioned, the housing 1 may be manufactured by extrusion, and in this case it is preferred to use aluminium for reasons of weight. Alternatively, the housing 1 may be manufactured by injections molded plastic using a suitably rigid plastics material, such as polypropylene. A band stop 11 ensures that the device is stopped, if the metal band should run out.

Figure 6:
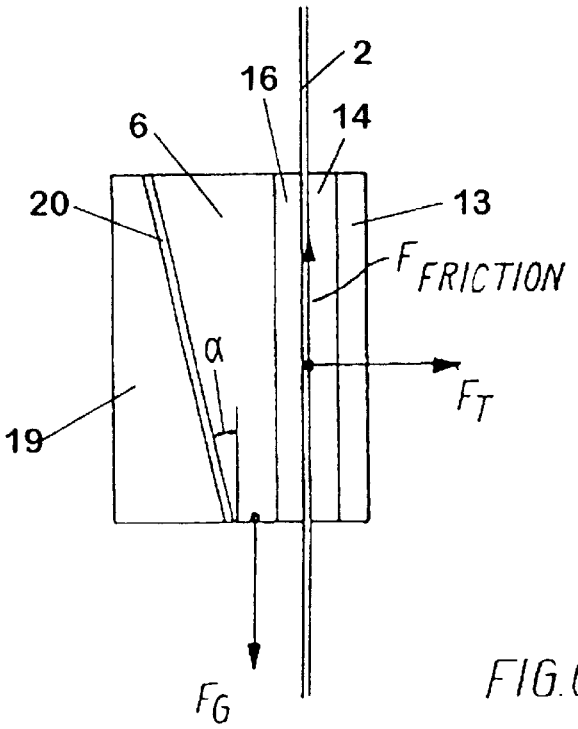
FIG. 6 shown the forces acting on a wedge assembly of the type used according to the invention.

The technical principles of the invention will be explained in connection with FIG. 6, which shows that the band 2 in enclosed by two brake shoes 14, 16, as know in the art mounted on a box-shaped block 13 and on the load wedge 6, respectively, on which a force $F_G$ acts. A further wedge 19 is rigidly mounted through a yoke (not shown) with respect to the block 13, so that the wedge 19 and the block 13 essentially cannot be moved with respect to each other. An expansion joint 20, e.g. of rubber, is provided between the wedge 19 and the load wedge 6. The expansion joint 20 ensures slight movement between the wedges, but is otherwise essentially non-compressible. The wedge 6 diverges at an angle a away from the point of attachment. A pull in the wedge 6 is converted to a pressure $F_T$, which acts on the metal band, and which may be expressed as follows:

$$F_T = F_G/\tan(\alpha).$$

A frictional force $F_{FRIX}$ from the engagement of the brake shoes with the metal band may be expressed as follows:

$$F_{FRIK} = \mu F_T$$

$\mu$ being the coefficient of friction between the brake shoes and the metal band. The lowering device is subjected to a resulting force $F_{RES}$, which may be written as the sum of the force of gravity $F_G$ acting on the load and the oppositely directed frictional force $F_{FRIK}$. The resulting force may be express as follows:

$$F_{RES} = F_G - F_{FRIK},$$

or $$F_{RES} - \mu F_G/\tan(\alpha).$$

It will be seen from this expression that the resulting force $F_{RES}$ may be regulated by adjusting the coefficient of friction $\mu$ and the wedge angle $\alpha$ with respect to each other. It will thus be seen that the frictional force represented by the second term of the expression, is greater than the first term of the expression with small angles $\alpha$, which causes the system to block. With large angles, the first term of the expression of the resulting force is greater than the second term, which means that a resulting force will act on the lowering device, which in turn means that the lowering takes place under the action of a constant acceleration. In a region where the coefficient of friction $\mu$ is approximately equal to $\tan(\alpha)$, the resulting force is small or equal to zero. The lowering can hereby take place at a constant speed without acceleration.

In practice, this region of constant speed of descent applies to a relatively wide angular area, which is caused by the fact that other forces are present in the lowering device of course. It was presumed, of course, in the description above that the yoke of the wedge assembly or the brake housing 4 is completely rigid. In practice, there will be some resiliency when the load wedge 6 is loaded. It was likewise presumed that the brake shoes 14, 16 were not elastic. Here, too, there will be some, although slight, resiliency. The expansion joint 20, which is a rubber layer in the preferred embodiment, constitutes an essential factor for the achievement of a relatively wide angular area where the resulting force is negligent. In the first place, this rubber layer imparts a certain bins to the brake shoes through the load wedge 6, while this layer will also have a certain spring force. In addition to the favourable effect of the expansion joint 20 on the speed of descent, this layer serves to make the descent more comfortable. It is well-known from other connections that, when the brake shoes are rigidly mounted with respect to each other, a thin body moved between two brake shoes involves irregular braking or possibly blocking if the body has thickness variations of a given size. The rubber expansion joint 20 essentially ensures even braking.

In the preferred embodiment, the metal band is selected as a stainless spring steel band AISI 301 having cut edges. The tolerances of the steel band may advantageously be according to DIN 1544. A commercially available steel band of this type has e.g. a breaking strength of about 1870 N/mm$^2$, a width of 12 mm, and a thickness of 0.20 mm.

Figure 2:
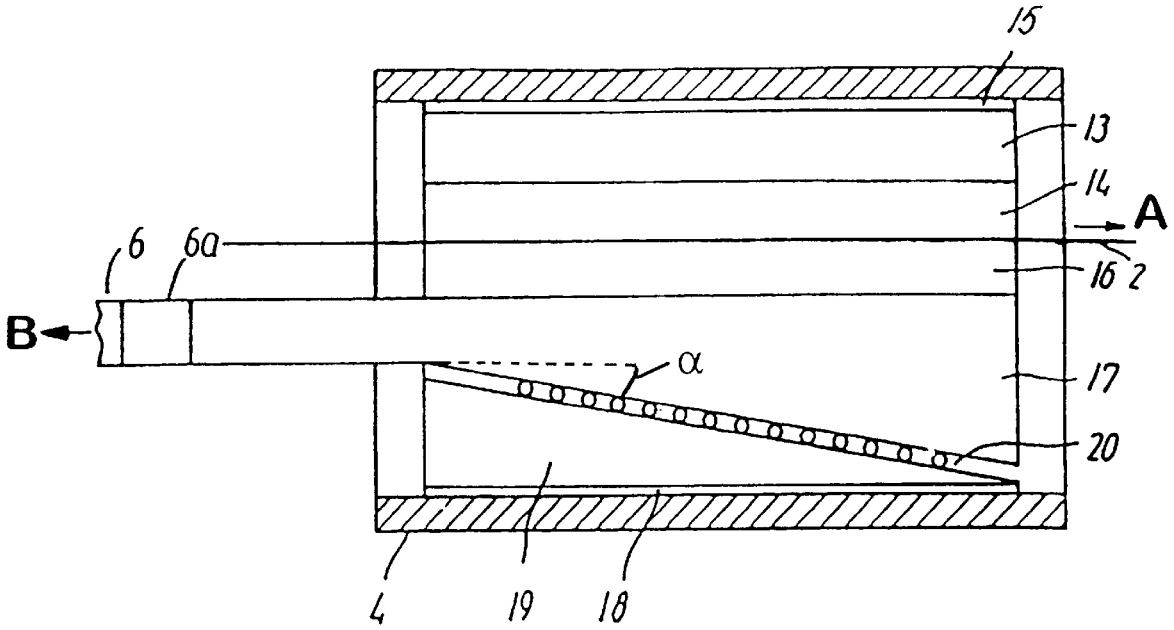
FIG. 2 is a sectional view of a preferred embodiment of a brake housing for a lowering device according to the invention.

FIG. 2 shows a preferred embodiment of a brake housing according to the invention. The actual housing 4 has four outer walls which define the housing with a rectangular cross-section. It is noted that the housing has no end walls, which is not necessary since the individual parts in the housing are contiguous and are moreover attached to the side walls of the housing. A first brake shoe 14 is mounted on a carrier block 13, which is mounted on one side wall of the housing 4 via a binding layer 15. A second brake shoe 16 is mounted on a load wedge 17 having a protruding part 6. The load wedge 17 converges towards the protruding part 6 at an angle of convergence α. The load wedge 17 cooperates with a stationary wedge 19 through an expansion joint 20, which consists of a rubber layer in the preferred embodiment. The stationary wedge 19 is fixed to the other side wall of the housing 4 by means of a binding layer 18. The metal band 2 passes between the brake shoes 14, 16 in the direction shown by the arrow A, and a pull in the protruding part 6 of the load wedge in a direction shown by the arrow B is, as mentioned before, converted into a pressure on the metal band 2, which causes the lowering device with suspended load to be braked.

Figure 3:
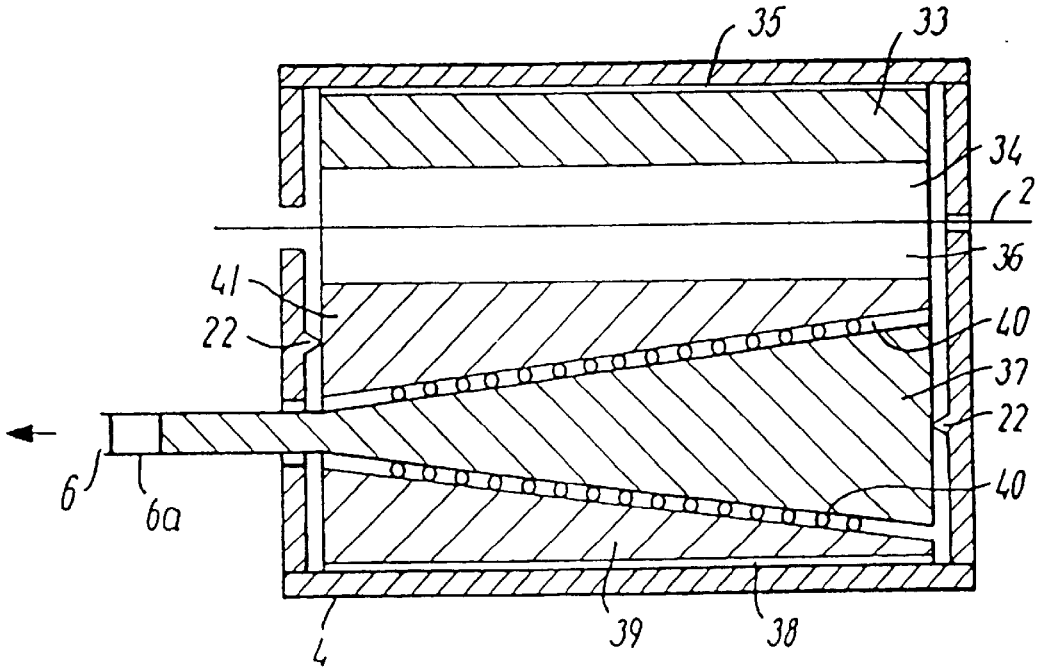
FIG. 3 is a sectional view of an alternative embodiment of a brake housing for a lowering device according to the-invention.

FIG. 3 Shows an alternative embodiment of a brake housing 4 for a lowering device according to the invention. Here, too, the brake housing 4 is formed as a rectangular tubular profile and may e.g. be made of aluminium by extrusion. It is additionally noted that the brake housing 4 is formed with partly closed end faces, there being gaps, of course, providing access for the metal band 2 and the protruding part 6 of the load wedge. A first brake shoe 34 is mounted on a carrier block 33, which is attached to one side wall of the housing through a suitable binding layer 35 of e.g. glue or adhesive. A second brake shoe 36 is mounted on a separate brake shoe wedge 41 which is loosely slidable in the housing 4. One and wall of the housing 4 is provided with a stop 22 which serves as a limit for the broke shoe wedge 41, thereby ensuring that the brake shoes 34, 36 are aligned in use. Lateral movement of the wedge 41 is counteracted by housing sides (not shown), there being only just enough space between the sides of the wedges and the housing 4 for the wedges to move mutually. In this case, a load wedge 37 is formed with two wedge faces, both of which diverge/converge with respect to the metal band 2. The angle of divergence of the load wedge 37 away from the attachment eye 6*a*, together with the coefficient of friction between the brake shoes 34, 36 and the metal band 2, determines the size of the frictional force.

Because of the shape of the load wedge 37 a further stationary wedge 39 is provided, attached to the side of the brake housing 4 through an adhesive layer 38. To ensure friction-less displacement of the wedges, friction reducing means 40 are arranged between the wedge load 37 and both the braking shoe wedge 41 and the stationary wedge 39, said friction- reducing means 40 being here in the form of loosely fitted roller bearing bands which consist of a plurality of axis-parallel steel rolls embedded in a thick band of e.g. polypropylene. Such roller bearing bands are commercially available by the metre. Since the wedges are loosely mounted An the brake housing 4 in the embodiment shown in FIG. 3, one end wall of the housing is formed with a stop 22 which limits the movement of the load wedge 37 to some degree.

It is common to the brake housings 4 shown in FIGS. 2 and 3 that the load moves down the metal band 2 at a substantially constant speed where a person is being lowered, the person can increase this speed by gripping the housing 1 of the lowering device, and he will hereby move part of his weight from the protruding part of the load wedge to the housing of the lowering device. This means that the force of gravity acting on the lowering device 1 remains constant, while the frictional force decreases, since the pressure of the load wedge against the metal band 2 through the brake shoes diminishes. The descent will hereby take place at a greater speed, until the load is moved back to the load wedge again.

It will be seen from the expressions previously formed that the greater the friction is between brake shoes and metal band, the greater the wedge angle has to be. If the coefficient of friction a between brake shoes and metal band is of the order of 0.02, the wedge angle must be of the order of about 11°. If the wedge is e.g. of the order of 8°, the system blocks. Wedge angles of the order of 13°–15° are permissible when using rubber as an expansion joint, since the rubber then ensures that the load does not begin accelerating. Suitable rubber materials may be used, both natural and synthetic ones.

Figure 4:
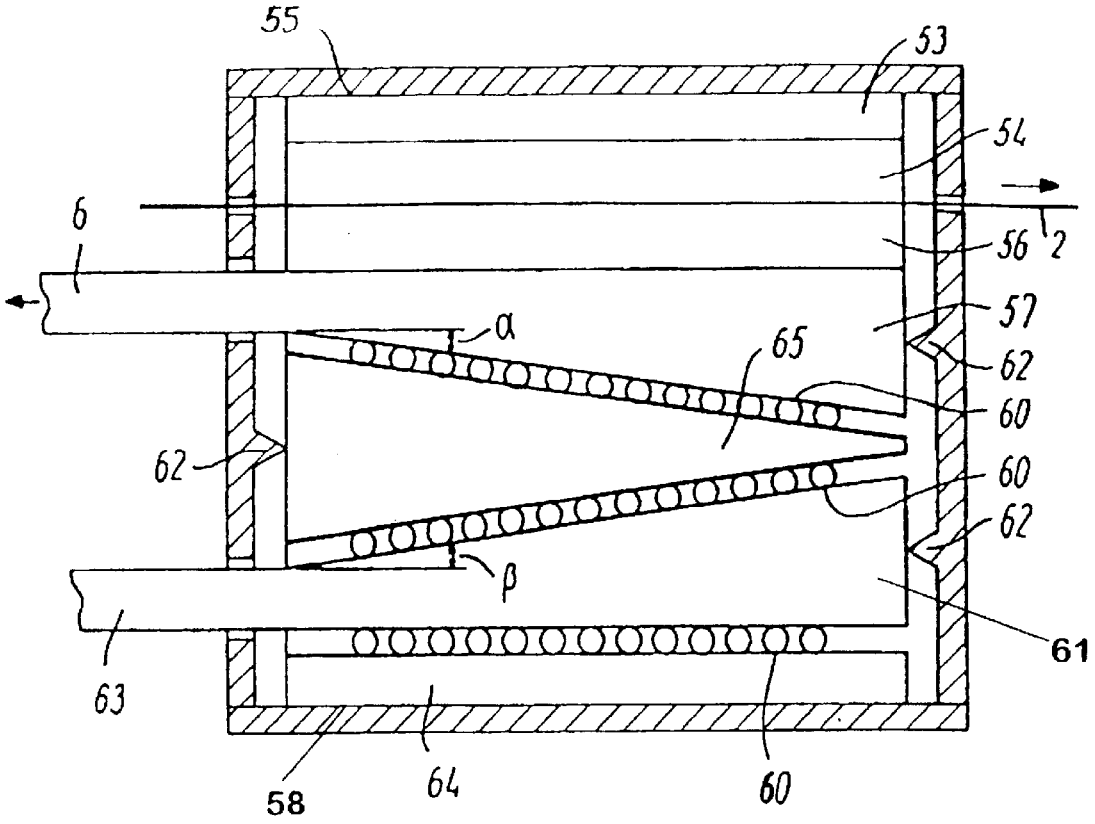
FIG. 4 is a sectional view of a further alternative embodiment of a brake housing for use in a lowering device according to the invention.

FIG. 4 shows a further alternative embodiment of a brake housing for use in connection with a lowering device according to the invention. It is noted here that the metal band 2 runs between two brake shoes 54, 56, one of which being mounted on a carrier block 53 which is fixed with respect to one side wall of the brake housing through a binding layer 55. The other brake shoe 56 is mounted on a load wedge 57 having a wedge angle α. The load wedge 57 has a protruding part 6 from which the load is suspended. The load wedge 57 abuts a stop 62 on one end wall of the brake housing. The other wedges of the wedge assembly include a further load wedge 61 which has a wedge angle β and a protruding wedge part 63. The additional load wedge 61 abuts a stop 62 on one end wall of the brake housing. The load wedges 57 and 61 have interposed between them an intermediate wedge 65 whose wedge angle is the sum of the wedge angles of the load wedges, and this intermediate wedge 65 abuts a stop 62 on the other end wall of the brake housing. A carrier block 64 is interposed between the load wedge 61 and the side wall of the brake housing. This carrier block 64 is attached to the side wall of the brake housing through a binding layer 58. Rubber expansion joints 60 are provided between the load wedges 57, 61 and the wedge 65 and between the supporting block 64 and the wedge 65, thereby permitting a certain mutual displacement of the wedges.

It is noted that the angles α and β are different, the angle α being greater than the angle β. The angle a may be chosen so that the load, when suspended from the protruding part 6 of the load wedge 57, is moved downwards at a constant speed, e.g. of 2 meters per second. When the load is suspended from the protruding part 63 of the load wedge 61, suitable selection of the angle β may cause the brake mechanism of the lowering device to block. The person who is being lowered by the lowering device does not necessarily have to change suspension point, but may e.g. operate a lever (not shown) to engage the protruding parts 6, 63 on the two load wedges 57, 61. It is hereby possible to obtain precise braking of the lowering device. This may be expedient e.g. if a person wants to evacuate himself from a storey of a multi-storey building to another lower storey of the multi-Storey building. It may also be expedient to be able to brake the lowering device immediately before reaching the ground.

FIG. 5 shows a further alternative embodiment of a lowering device according to the invention, which is generally designated 1 like before. The metal band 2 is wound around a spool and provided with a band stop 11 in the form of a soldered lump at the band end preventing the metal band 2 from passing right through the brake housing 4. The brake housing 4 accommodates a load wedge 77 which has a protruding part 6 with an eye 6*a* in which a ring 70 with a nut is secured. The load may be suspended from this ring, and where lowering of a person is involved, a sling may advantageously be used, with the ring attached at the chest of the person. The person can hereby hang stably with his centre of gravity below the ring 70. A brake shoe 76 is secured to the load wedge 77 through a carrier block 86. Another brake shoe 74 is affixed to the side wall of the brake housing 4 through a further carrier block 73. The wedge face of the load wedge 77 cooperates with a corresponding wedge face on a stationary wedge 79 which is with a corresponding wedge face on a stationary wedge 79 which is attached to the other side wall of the brake housing 4. An expansion joint 80 consisting of a suitable rubber layer is provided between the load wedge 77 and the stationary wedge 79. It is noted that the protruding part 6 of the load wedge 77 is formed with a shoulder 6*b* in which a biassing screw 84 is fitted. The biassing screw 84 cooperates with internal threads in a bore in the shoulder 6*b*, by means of which the load wedge 77 may be biassed with respect to a stationary wedge 76 in the longitudinal direction of the metal band 2. It is noted that in the area at which the screw 84 abuts, the stationary wedge 79 is formed with a depression in which a material, e.g. rubber, is embedded. Regulation of the bias between the two wedges with the screw 84 enables control of the speed of descent, which, however, in practice takes place by means of an adjustment button having a marking scale, but the screw 84 illustrates the technical principle sufficiently.

A drop-shaped ring 86 having a central eye 87 is provided at the free end of the metal band 2. The actual-band 2 runs along the periphery of the ring 86 in a channel provided for the purpose and, having formed a loop, is attached in a block 89, the metal band 2 being deformed with a plurality of waves transversely to its longitudinal direction, so that the overlapping parts of the band cannot be displaced with respect to each other. A suitable binder 89 may be provided between the parts of the band, and the block 88, in which the overlapping parts of the metal band 2 are arranged, may e.g. be a sleeve of epoxy resin, copper or another heat resistant material.

The lowering device 1 may e.g. be secured to the premises from which the lowering takes place, by running a steel cable through the eye 87 and joining it using snap hooks or the like.

It will be appreciated that the actual lowering device may be made extremely light, since the housing 1 may be formed of aluminium or plastics, while the wedges in the wedge assembly are relatively small and may be made of steel or aluminium when using rubber expansion joints. The weight of the steel band 2 depends on its length and constitutes the dominating portion of the weight of the actual lowering device. It the metal band 2 has a length of 30 meters, the total weight of the metal band with the previously stated dimensions will be of the order of ½ kg. It will be appreciated that it is expedient in some situations that the metal band 2 is longer, if the evacuation point concerned is higher.

It will likewise be appreciated that it will be possible to couple several lowering devices in extension of each other, since the ring 70 may be mounted in the eye 87 on the following device. It will likewise be appreciated that other persona may follow a person who has used a lowering device as described above. These following persons thus do not need to have their own metal band 2, but can re-use the metal band of the person lowered first. Thus, they just need a brake housing that can be opened to insert the band, so that the brake shoes can be caused to squeeze the metal band.

It will likewise be appreciated that it will be possible to achieve the required friction between metal band and brake shoes, even if just a single brake shoe is used. The metal band 2 will thus slide between this single brake shoe, on which the load wedge acts, and a rest with a suitable friction. Thus, this rest does not have to be coated with a brake block.

We claim:

1. A lowering device for lowering a load having a mass along a metal band, the lowering device comprising:

a flat metal band;

a brake housing including a brake mechanism, the brake mechanism having first and second brake shoes, at least one of said first and second brake shoes acting on the metal band, the metal band passing through the brake housing, said at least one of said first and second brake shoes having a fixed surface being pressed against the metal band by a force depending on the mass of the load to frictionally engage with the metal band;

a load wedge for suspending the load at an attachment point, the load wedge being movably accommodated in the brake housing and which, in the brake mechanism, converts a pull substantially in the longitudinal direction of the metal band to a pressure acting on the metal band through said at least one of said first and second brake shoes; and said first brake shoe being arranged stationarily with respect to the brake housing, and said second brake shoe being arranged to be acted upon by said load wedge.

2. A device according to claim 1, further comprising two brake shoes, one of said brake shoes being arranged stationarily with respect to the brake housing, the other brake shoe being arranged to be acted upon by said load wedge.

3. A device according to claim 1, further including one spool chamber inside of which the metal band is wound so as to be supported laterally and exteriorly in a radial direction.

4. A device according to claim 3, further comprising a housing with the spool chamber as an integrated part, said housing being formed with a brake chamber to receive and retain the brake housing.

5. A device according to claim 2 wherein the brake housing accommodates a wedge assembly, and that a pull in the longitudinal direction of the load wedge is converted to a pressure in the transverse direction of the wedge assembly.

6. A device according to claim 5, wherein friction-reducing means engage the load wedge of the wedge assembly.

7. A device according to claim 6, wherein the friction-reducing means are an expansion joint of rubber.

8. A device according to claim 5, wherein the brake shoe acted upon by the load wedge is mounted on a first wall of the load wedge, while a second wall of the load wedge cooperates with another wedge incorporated in the wedge assembly, the first and second walls of said load wedge converging with each other in a direction towards the attachment point of the load.

9. A device according to claim 8, wherein the wedge assembly includes a second externally stressable wedge, and that the angle of convergence between the wedge walls of said second wedge is smaller than the angle of convergence of the load wedge.

10. A device according to claim 5, wherein the load wedge has walls which converge in a direction towards the attachment point of the load, and that a first wedge wall of the load wedge cooperates with a further wedge incorporated in the wedge assembly, said further wedge carrying the brake shoe.

* * * * *